US010815643B2

(12) United States Patent
Wuisan et al.

(10) Patent No.: US 10,815,643 B2
(45) Date of Patent: Oct. 27, 2020

(54) ADJUSTABLE USER INPUT DEVICE ASSEMBLY

(71) Applicant: Deere & Company, Moline, IL (US)

(72) Inventors: Giovanni A. Wuisan, Epworth, IA (US); Scott J. Breiner, Dubuque, IA (US); Ronald J. Huber, Dubuque, IA (US)

(73) Assignee: Deere & Company, Moline, IL (US)

( * ) Notice: Subject to any disclaimer, the term of this patent is extended or adjusted under 35 U.S.C. 154(b) by 99 days.

(21) Appl. No.: 16/030,401

(22) Filed: Jul. 9, 2018

(65) Prior Publication Data

US 2020/0011028 A1 Jan. 9, 2020

(51) Int. Cl.

| | |
|---|---|
| ***G05G 9/047*** | (2006.01) |
| ***E02F 9/20*** | (2006.01) |
| ***G05G 1/06*** | (2006.01) |

(52) U.S. Cl.

CPC ..... *E02F 9/2004* (2013.01); *G05G 1/06* (2013.01); *G05G 9/047* (2013.01); *G05G 2009/04774* (2013.01)

(58) Field of Classification Search

CPC ..... E02F 9/2004; G05G 1/06; G05G 9/047; G05G 2009/04703; B60K 2370/135; B60K 2026/029; B64C 13/0421

USPC ..... 74/471 XY

See application file for complete search history.

(56) References Cited

U.S. PATENT DOCUMENTS

| | | | | |
|---|---|---|---|---|
| 5,630,756 | A * | 5/1997 | Thurston | A63F 13/06 463/38 |
| 6,341,821 | B1 | 1/2002 | Rousseau | |
| 2004/0221674 | A1 | 11/2004 | Kornelson | |
| 2018/0107236 | A1* | 4/2018 | Weigand | G05G 9/04792 |
| 2018/0253158 | A1* | 9/2018 | Chen | G06F 3/0338 |

FOREIGN PATENT DOCUMENTS

| | | | |
|---|---|---|---|
| JP | 2002332661 A | * | 11/2002 |
| JP | 2002332661 A | | 11/2002 |

* cited by examiner

*Primary Examiner* — Randell J Krug

(57) ABSTRACT

An adjustable user input device assembly comprising a handle having a first portion, a second portion, and a palm portion for receiving the palm of an operator's hand, the palm portion located between the first portion and the second portion; an elongated support having a first support portion and a second support portion, the first support portion coupled to the handle through an adjustable coupling mechanism, the second support portion coupled to a control console, the adjustable coupling mechanism configured to slidably adjust the handle to at least one of a pistol grip position, a palm-on-top grip position, or a position therebetween.

19 Claims, 14 Drawing Sheets

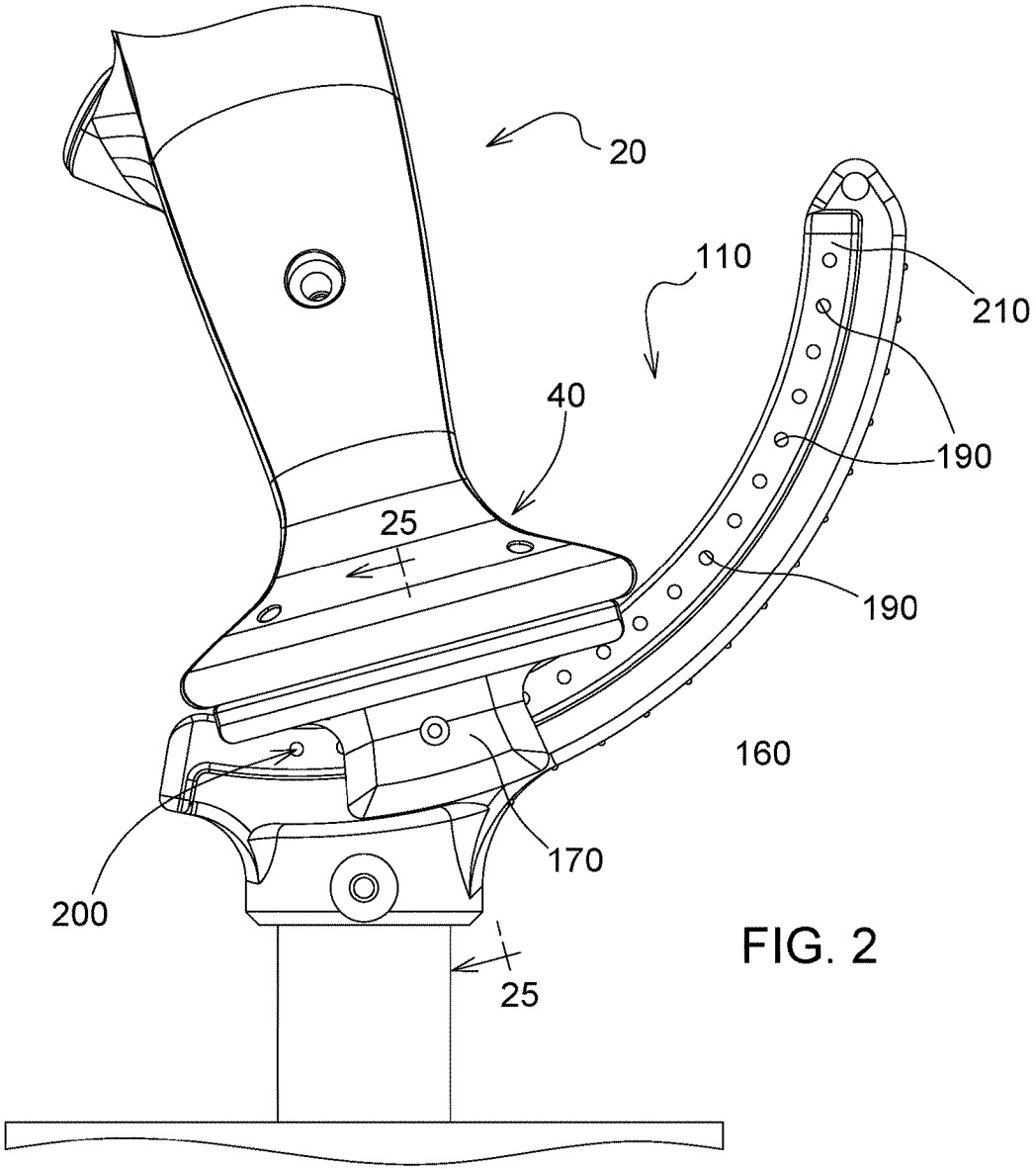
FIG. 2
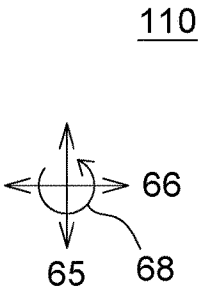

ADJUSTABLE USER INPUT DEVICE ASSEMBLY

CROSS-REFERENCE TO RELATED APPLICATIONS

N/A

FIELD OF THE DISCLOSURE

The present disclosure relates generally to an adjustable user input device assembly for a work machine.

BACKGROUND

It is well known that operators of work machines such as crawlers, dozers, loaders, pipelayers, motorgraders, agricultural machines, and forestry machines may operate a work machine for extensive periods of time. An operator may sit in an operator station for up to 16 hours a day, maneuvering the machine through a user input device involving a myriad of buttons and typically at least one handle. The user input device is generally different from one machine type to another, and may also differ between manufacturers for similar machines. For instance, the handle orientation may only be offered in a vertical upright position for some machines, and only be offered in a horizontal position for other machines, wherein neither handle-types are adjustable. These limitations place physical demands on the operator and can result in substantial time for the operator to re-familiarize themselves to a new user input device assembly when switching between machines.

Additionally, several operators may alternate through use of a single machine, thereby requiring adjustment of the operator seat in response to any adjustments in the user input device. To address the issues outlined above, therein lies a need for a single user input device that allows for maximum operator comfort and flexibility, and adjustability to easily adapt the user input device based on the operator's preferences for the machine.

SUMMARY

This summary is provided to introduce a selection of concepts that are further described below in the detailed description and accompanying drawings. This summary is not intended to identify key or essential features of the appended claims, nor is it intended to be used as an aid in determining the scope of the appended claims.

The present disclosure includes a work machine including a control console and an adjustable user input device assembly.

The user input device assembly comprises a handle with a first portion, a second portion, and a palm portion for receiving the palm of an operator's hand. A thumb rest may be coupled to the first portion of the handle. The palm portion is located between the first portion and the second portion. The user input device assembly further comprises an elongated support with a first support portion and a second support portion. The first support portion is coupled to the handle through an adjustable coupling mechanism. The second support portion is coupled to the control console. The adjustable coupling mechanism is configured to slidably adjust the handle to at least one of a pistol grip position, a palm-on-top grip position, and a plurality of positions therebetween.

In one embodiment, the adjustable coupling mechanism comprises an arched slide and an adapter with a groove. The arched slide is fixedly coupled to the first support portion of the elongated support. The adapter is fixedly coupled to the second portion of the handle. The arched slide is retained in the groove of the adapter, and the adapter is slidable along the arched slide. The arched slide may have a row of detent notches allowing for the adapter to selectively engage with the row of detent notches for locking the adapter in a position. This row of detent notches may be incrementally spaced. A first detent notch may couple the handle to a pistol grip position. A second detent notch may couple the handle to a palm-on-top grip position.

The adapter may further comprise an aperture to receive a locking pin where the locking pin engages with the detent to lock the adapter in a position.

Alternatively, the adapter may comprise a spring-loaded protrusion located in the groove where the protrusion engages with the detent to lock the adapter in a position.

The palm portion of the handle for receiving the palm of an operator's hand, maintains a consistent axis of rotation coinciding with at least one of a medial rotation or a lateral rotation of the operator's palm when adjusting from the pistol grip position, the palm-on-top grip position, or the plurality of positions therebetween.

In another embodiment of the adjustable coupling mechanism, the arched slide is fixedly coupled to the first support portion where the arched slide has a groove with the groove having a row of detent apertures; and an adapter fixedly coupled to the handle, where the adapter is slidable within the groove and selectively engages with the row of detent apertures for locking the adapter in a position. The adapter may further comprise a detent to receive a locking pin, where the locking pin engages with the aperture on the arched slide to lock the adapter in a position. Alternatively, the adapter may further comprise a spring-loaded protrusion where the protrusion engages with the aperture to lock the adapter in a position.

These and other features will become apparent from the following detailed description and accompanying drawings, wherein various features are shown and described by way of illustration. The present disclosure is capable of other and different configurations and its several details are capable of modification in various other respects, all without departing from the scope of the present disclosure. Accordingly, the detailed description and accompanying drawings are to be regarded as illustrative in nature and not as restrictive or limiting.

BRIEF DESCRIPTION OF THE DRAWINGS

The detailed description of the drawings refers to the accompanying figures in which:

FIG. 2 is a side view of a first embodiment of the coupling mechanism;

Like reference numerals are used to indicate like elements throughout the several figures.

DETAILED DESCRIPTION

The present disclosure describes an adjustable user input device assembly for a work machine with a control console. The machine may be, but is not limited to, a crawler, a dozer, a loader, a pipelayer, motograder, an agricultural machine, a forestry machine, or any other machine having an operator compartment. Alternatively, the operator compartment may be merely associated with a work machine (e.g. an operator station that is capable of maneuvering a work machine in the field from a remote location rather than situated within an operator compartment atop a work machine).

Figure 1:
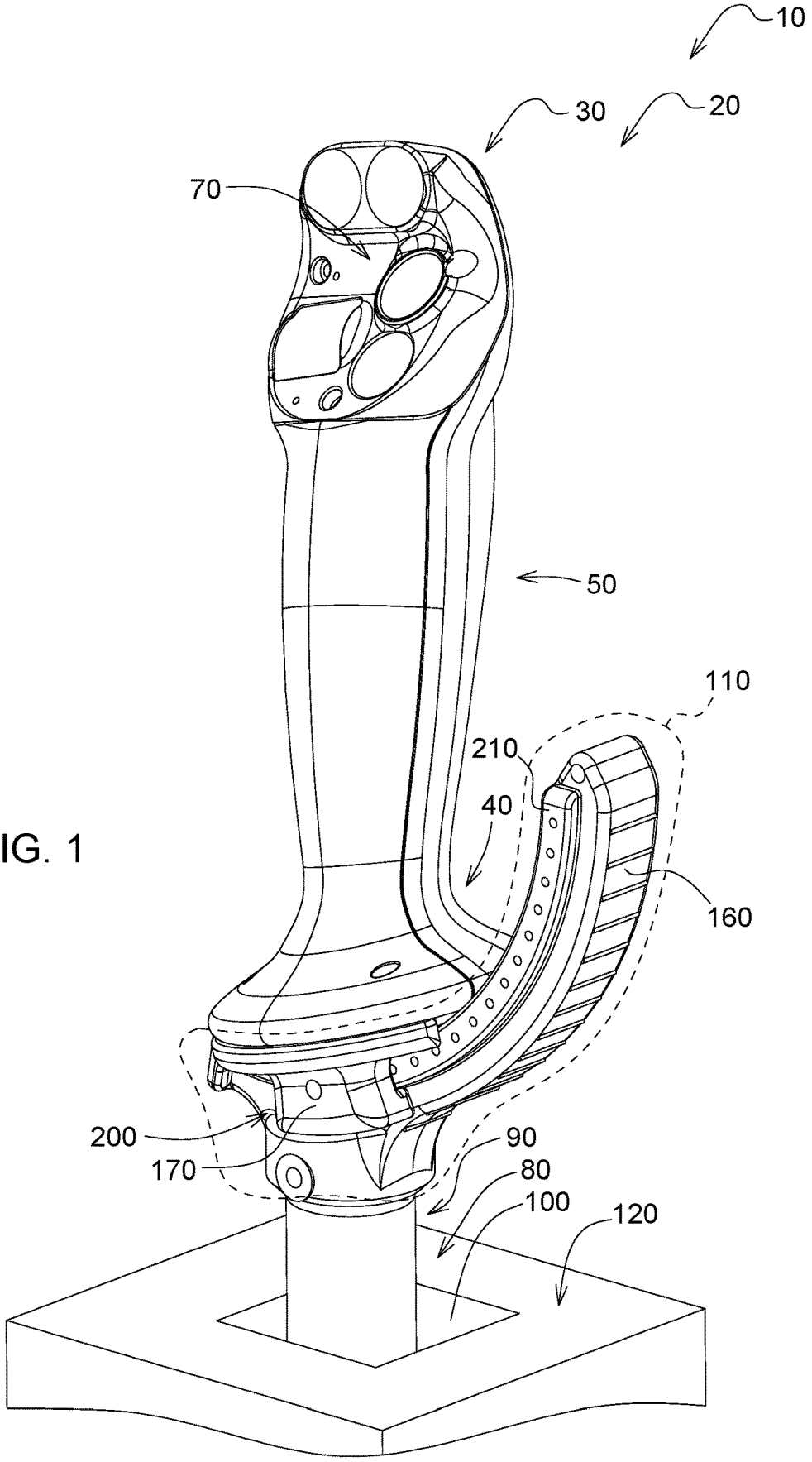
FIG. 1 is a perspective view of the user input device assembly.

FIG. 1 illustrates a perspective view of a first embodiment of the user input device assembly. Please note that although the assembly shown is configured for right hand use, a user input device assembly may also be configured for left hand which would be the mirror image of the embodiment shown, or alternatively the handle may be designed such that it is ambidextrous. Please also note, that in reference to FIGS. 2-4, 8, 10, and 13-15, the user input device assembly has a horizontal dimension 66, a vertical dimension 65, a lateral dimension 67, and in some embodiments, the ability to rotate about the vertical dimension 68 (also referred to as yaw axis). The user input device assembly 10 comprises a handle 20 with a first portion 30, a second portion 40, and a palm portion 50 for receiving the palm of an operator's hand 60 (shown in FIGS. 6A-6F). The palm portion 50 is located between the first portion 30 and the second portion 40. The first portion 30, the second portion 40, and the palm portion 50 may further comprise a multitude of other operator input devices to actuate various components of the work machine. Such user input devices may include, and is not limited to, a push button, a switch, a lever, a roller, a key pad, a touch pad, or an infinity switch. The second portion 40, may be conically shaped wherein the base of the second portion 40 is wider than the top of the second portion 40 (i.e. the area closer to palm portion 50), thereby providing a support surface for a hand to rest when the handle 20 is vertical or substantially vertical. The second portion 40 also assists in correctly positioning the hand in the palm portion.

A thumb rest 70 may be coupled to the first portion 30 of the handle 20. As shown in FIG. 1, the thumb rest may comprise of a series of buttons and/or rollers to actuate various components of a work machine. A thumb rest 70, although not required, enhances the ergonomics of the handle 20. The thumb rest 70 may also be structurally integrated to the molded shape of the first portion 30 of the handle 20.

Now referring to FIGS. 1 and 2, the user input device assembly 10 further comprises an elongated support 80 with a first support portion 90 and a second support portion 100. The first support portion 90 is coupled to the handle 20 through an adjustable coupling mechanism 110. The second support portion 100 is coupled to the control console 120. The elongated support 80 translates movement of the handle 20 to the control console 120 where the operator may push, pull, move side-to-side, or otherwise manipulate the handle to maneuver and actuate various functions of the work machine.

The adjustable coupling mechanism 110 is configured to slidably adjust the handle 20 to at least one of a pistol grip position 130, a palm-on-top grip position 140, and a plurality of positions therebetween 150 (shown in FIGS. 3A-3C, 6A-6F). The pistol grip position 130 may be defined as the orientation of the handle 20 where the palm portion 50 is vertically upright or substantially vertically upright (shown in FIGS. 3A, 6A, and 6D). Substantially vertically upright is defined as anywhere between zero and forty-five degrees from the vertical axis 65. In the pistol grip position 130, when the palm of the operator's hand is engaged with the palm portion 50 of the handle 20, the palm is orientated parallel with the midline 290 (shown in FIG. 7), or between zero and forty-five from a plane parallel to the midline 290.

Figure 3C:
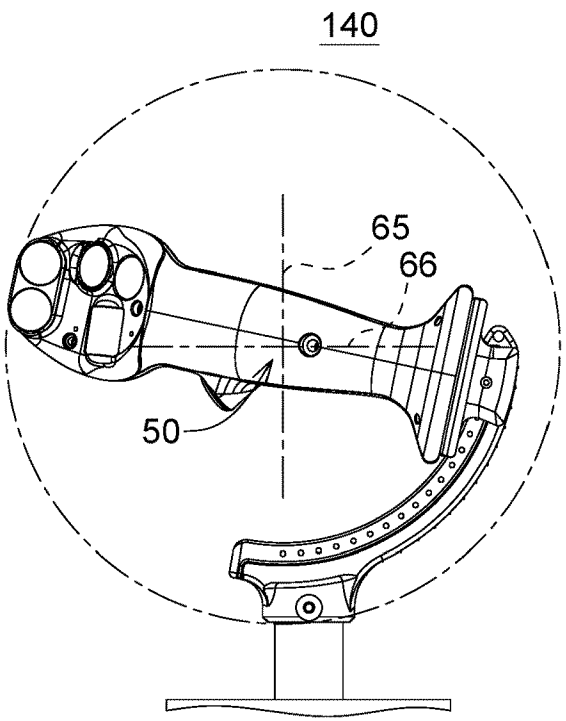
FIG. 3C is a schematic of the embodiment shown in FIG. 2 with the handle in a palm-on-top grip position.
Figure 3B:
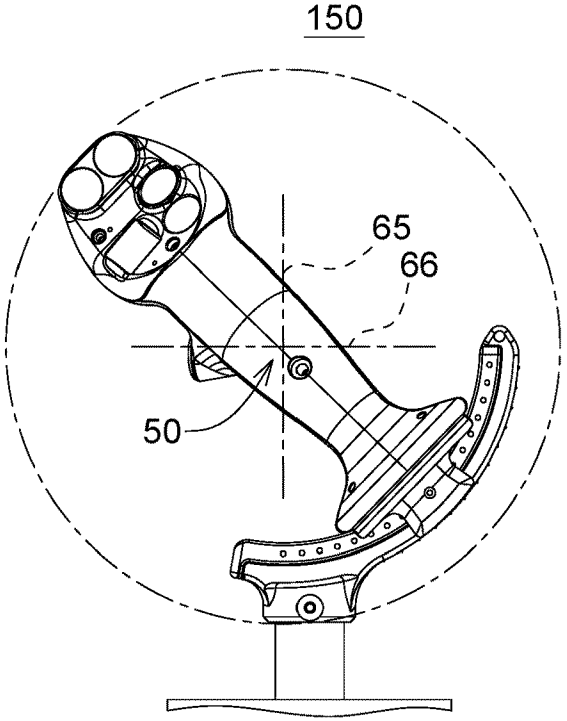
FIG. 3B is a schematic of the embodiment shown in FIG. 2 with the handle between a pistol grip position and a palm-on-top grip position.
Figure 6D:
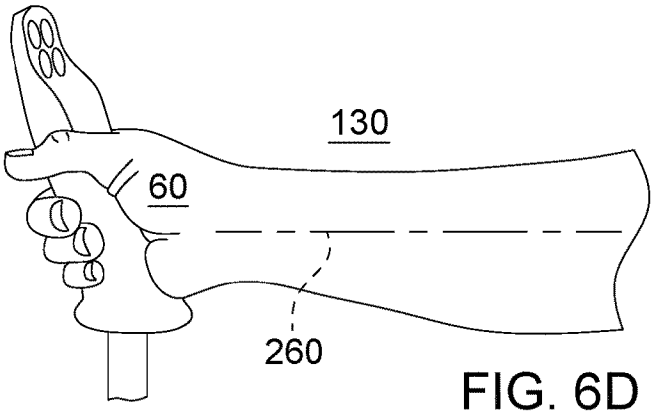
FIG. 6D is a side view of the handle receiving the palm of an operator's hand when in the pistol grip position.
Figure 6E:
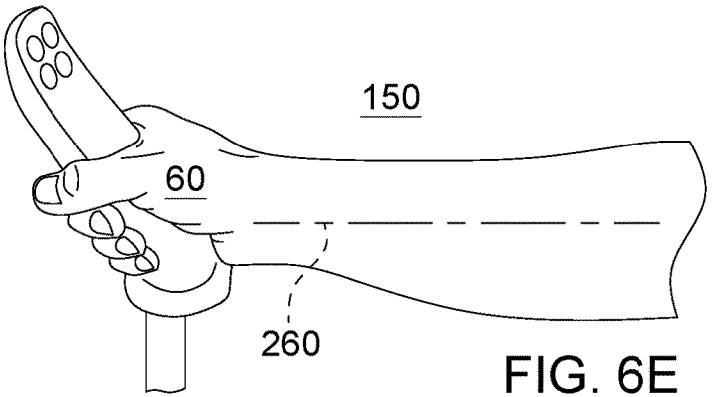
FIG. 6E is a side view of the handle receiving the palm of an operator's hand when in a position between a pistol grip position and a palm-on-top grip position.
Figure 6F:
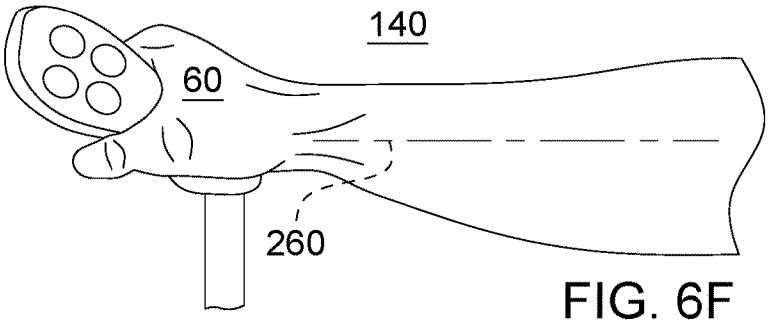
FIG. 6F is a side view of the handle receiving the palm of an operator's hand when in the palm-on-top grip position.
Figure 6A:
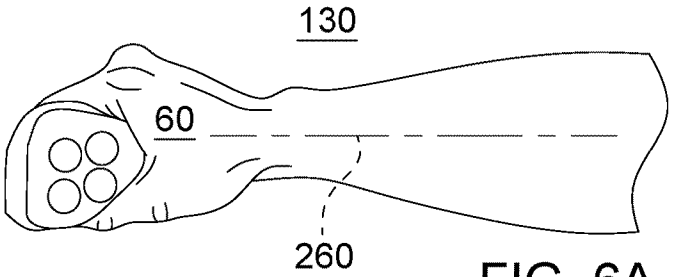
FIG. 6A is a top view of the handle receiving the palm of an operator's hand when in the pistol grip position.
Figure 6B:
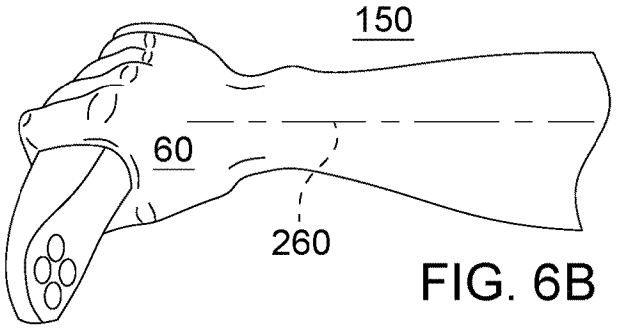
FIG. 6B is a top of the handle receiving the palm of an operator's hand when in a position between a pistol grip position and a palm-on-top grip position.
Figure 6C:
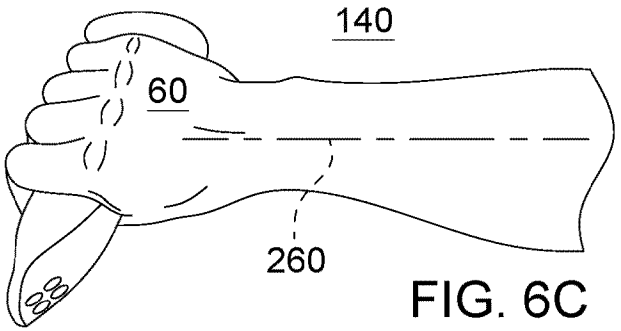
FIG. 6C is a top view of the handle receiving the palm of an operator's hand when in the palm-on-top grip position.

On the contrary, the palm-on-top grip position 140 may be defined as the orientation of the handle 20 where the palm portion 50 is horizontal or substantially horizontal (shown in FIGS. 3C, 6C, and 6F). Substantially horizontal is defined as anywhere between zero and forty-five degrees from the horizontal axis 66. In the palm-on-top grip position 140, when the palm of the operator's hand 60 is engaged with the palm portion 50 of the handle, the palm is oriented facing downwards with the thumbs facing towards the midline 290 (shown in FIG. 7), or nearly perpendicular to the midline 290, or between zero and forty-five degrees from a plane perpendicular to the midline 290. FIG. 3B is a schematic of the handle 20 positioned somewhere between the pistol grip position 130 and the palm-on-top grip position 140.

Figure 3A:
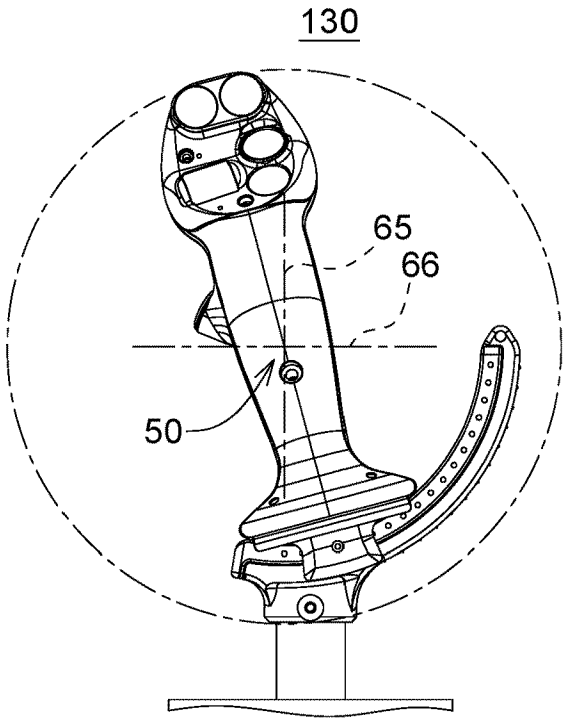
FIG. 3A is a schematic of the embodiment shown in FIG. 2 with the handle in a pistol grip position.
Figure 4:
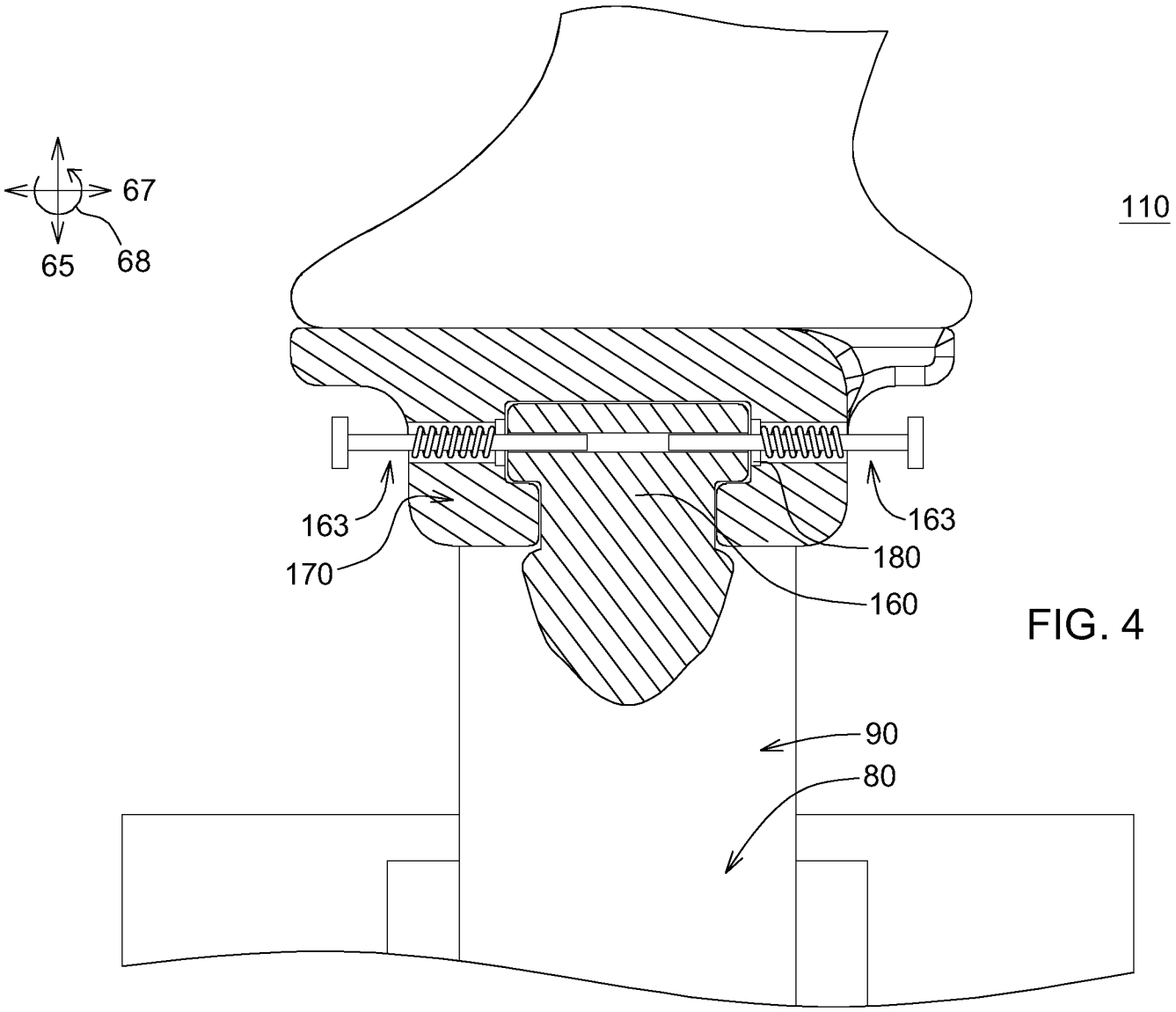
FIG. 4 is a cross-sectional back view of the embodiment shown in FIG. 2 of the coupling mechanism.
Figure 5:
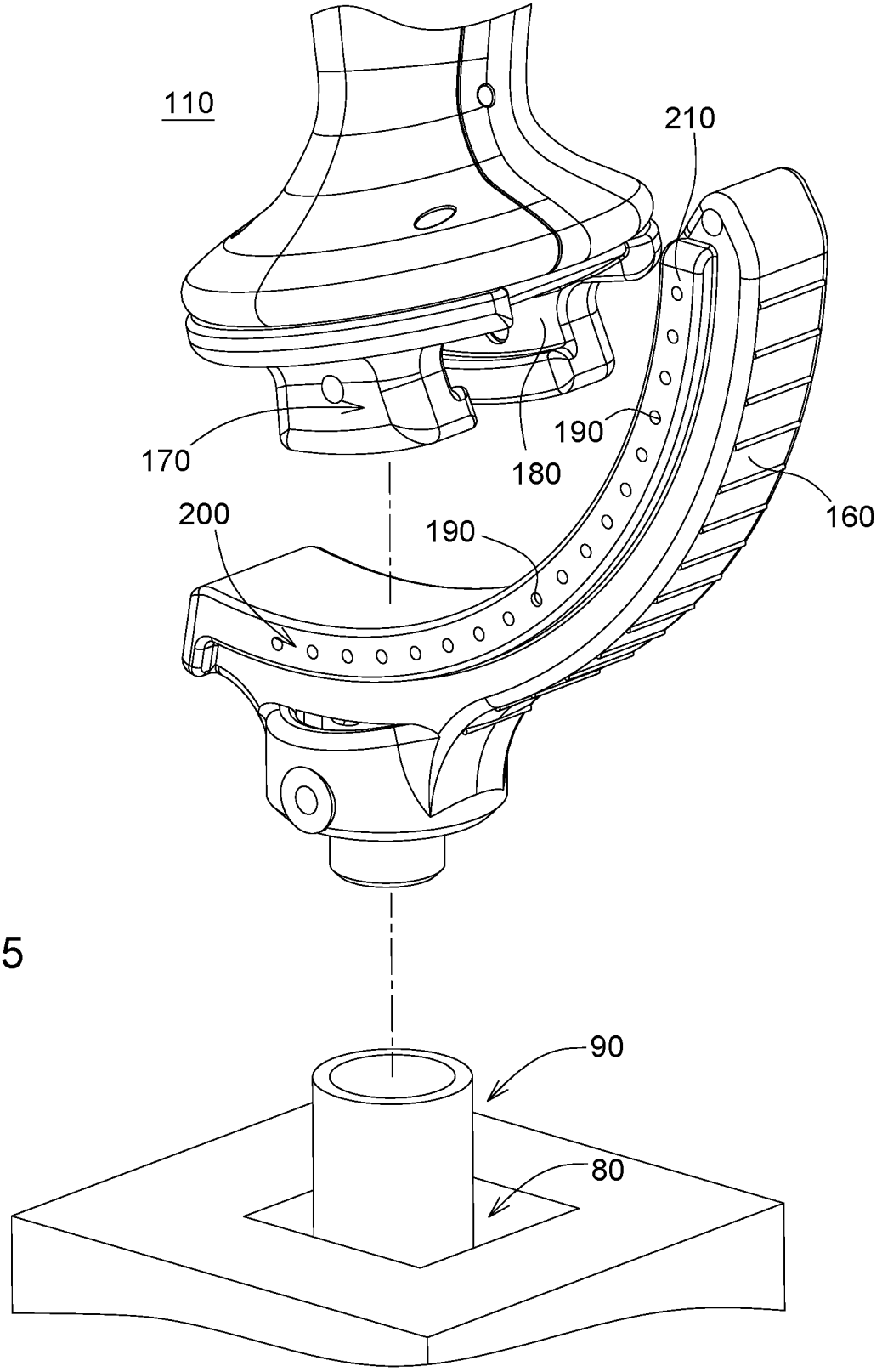
FIG. 5 is an exploded view of the embodiment shown in FIG. 2 of the coupling mechanism.

Referring to FIGS. 1 through 5, where FIG. 4 is a cross-sectional view along the axis 25, in a first embodiment, the adjustable coupling mechanism 110 comprises an arched slide 160 and an adapter 170 with a groove 180. The arched slide 160 is fixedly coupled to the first support portion 90 of the elongated support 80. The adapter 170 is fixedly coupled to the second portion 40 of the handle 20.

The arched slide 160 is retained in the groove 180 of the adapter 170, and the adapter 170 is slidable along the arched slide 160.

The arched slide 160 has a row of detent notches 190 (note that not every detent notch is individually identified) which allows for the adapter 170 to selectively engage with the row of detent notches 190 for locking the adapter 170 in a position. This row of detent notches 190 may be incrementally spaced. The incremental spacing may be in 10 degree increments along the arch of the arched slide. Alternatively, the incremental spacing may be in 5 degrees along the arch of the arched slide. A first detent notch 200 may couple the handle 20 to a pistol grip position 130. A second detent notch 210 may couple the handle 20 to a palm-on-top grip position 220. The series of detent notches in between may lock the handle in a position providing the greatest comfort and ease of operation for the operator and may further customize the user input device assembly 10 based on the work machine operated. The adjustable coupling mechanism 110 advantageously provides a universal, modular user input device assembly with the ability to adapt to a myriad of work machines, and personalize the device based on operator preferences. The modularity effectively reduces costs by reducing the number of parts required by the manufacturer in inventory. Furthermore, the modularity improves the operator's adaptation for use of a work machine when switching from one manufacturer to another. In another scenario, the adjustable coupling mechanism 110 provides a user input device assembly for a universal operator station where the operator may operate a multitude of type of work machines from a single operator station located remote from the work machine.

Figure 9:
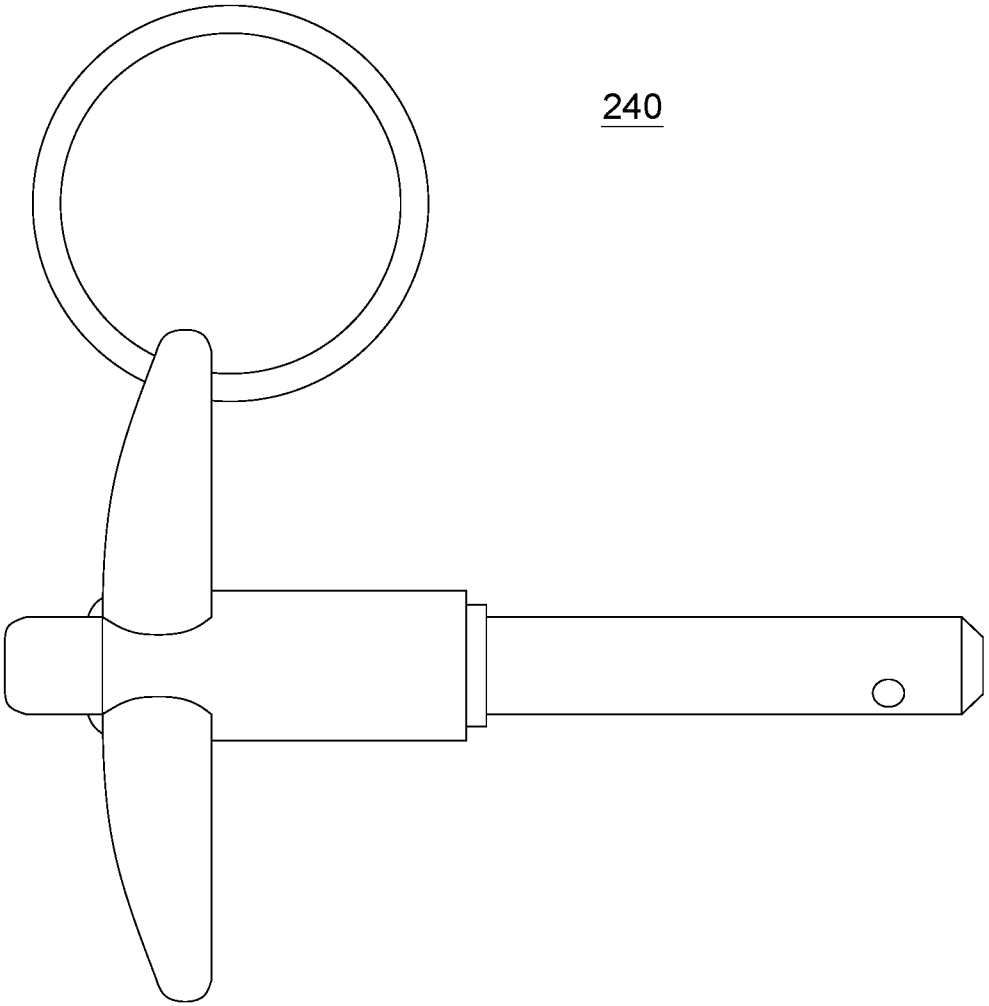
FIG. 9 is an embodiment of a locking pin.
Figure 10:
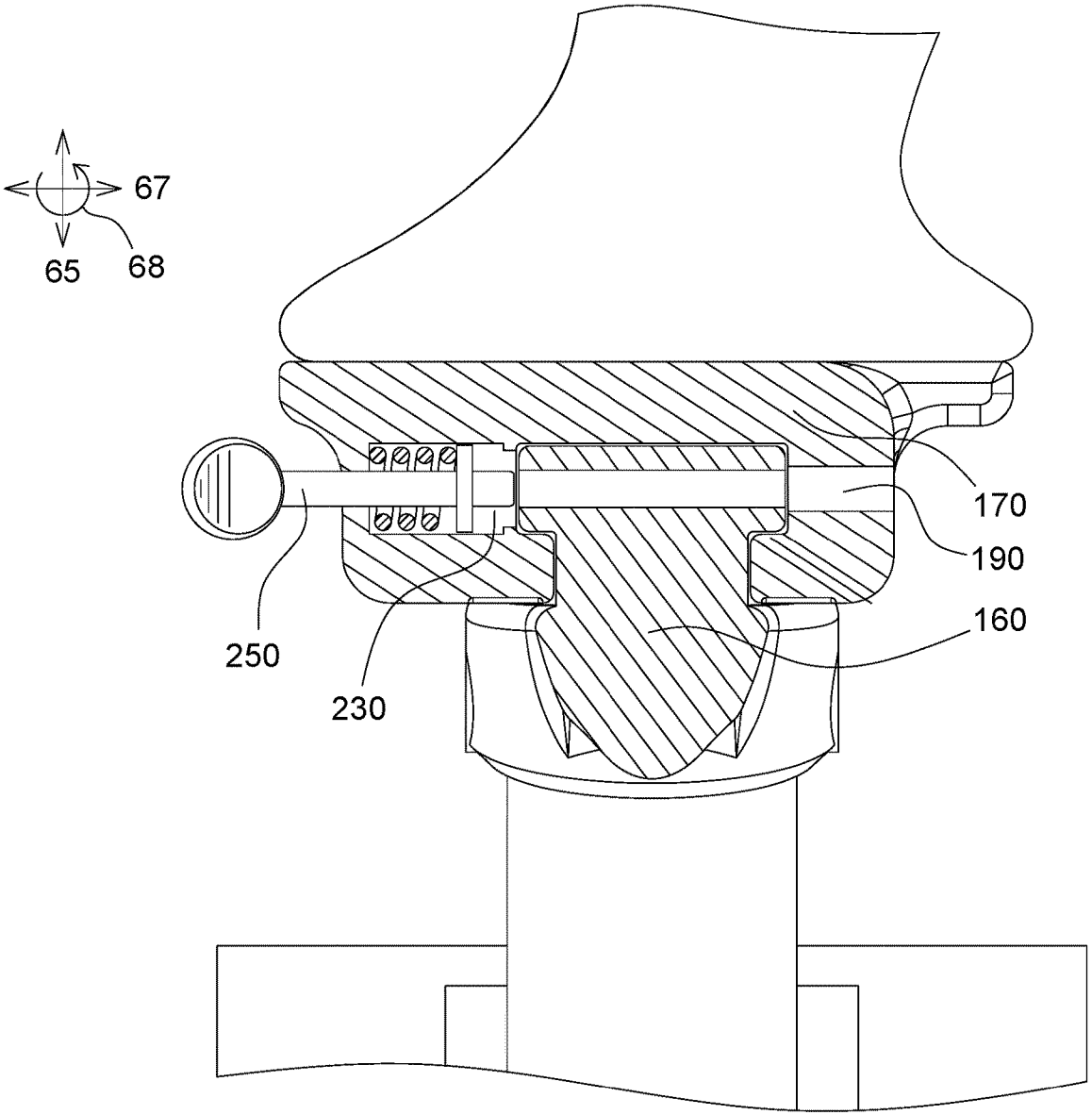
FIG. 10 is a cross-sectional back view of the second embodiment with a locking pin engaged with a detent.

Now turning to FIGS. 9 and 10, the adapter 170 may further comprise an aperture 230 to receive a locking pin 250 where the locking pin 250 engages with the detent notch 190 to lock the adapter 170 in a position. For example, the locking pin 250 may comprise of a slidable member that engages on a first end with a detent notch 190 in the arched slide 160, and on a second end configured to affix the locking pin into the aperture. The locking pin 250 may comprise of a spring-loaded protrusion located in the groove 180 where the protrusion 250 engages with the detent notch 190 to lock the adapter 170 in a position. The protrusion 250 may be coupled to a mechanism allowing for the spring to be compressed and thereby depress the protrusion when repositioning the adapter 170 from one position to another. FIG. 9 is another example of a locking pin depicting a standard quick release ball lock pin, as generally known in the art.

As shown in FIGS. 6A through 6F, and referring to FIGS. 3A through 3C, the palm portion 50 of the handle 20 for receiving the palm of an operator's hand 60, maintains a consistent axis of rotation 260 coinciding with at least one of a medial rotation 270 or a lateral rotation 280 of the operator's palm when adjusting from the pistol grip position 130, the palm-on-top grip position 140, or the plurality of positions therebetween 150. The axis of rotation 260 extends along the length of the operator's arm from the palm, through the wrist, and up to the operator's elbow. This axis of rotation 260 maintains a consistent position even when the operator's palm and thereby the operator's wrist/arm up to the elbow medially or laterally rotates to change from a pistol grip position to a palm-on-top grip position or a position therebetween, provided the configuration of the adjustable coupling mechanism 110. Movement of the operator's palm medially and laterally, can also be described as the operator's palm pronating and supinating, respectively. Additionally, maintaining a consistent axis of rotation 260 advantageously maintains the operator's middle knuckle position so that it is centered above the palm portion 50 regardless of the grip orientation. This allows for the center of gravity of an operator's hand to not affect the handle feel. This not only advantageously provides a modular device applicable to various work machines and an ergonomic solution as discussed above, but it eliminates the need for the operator to adjust the operator seat height and/or arm rest height when the handle is repositioned from a pistol grip position 130 to a palm-on-top grip position 140 or a position therebetween 150.

Figure 12:
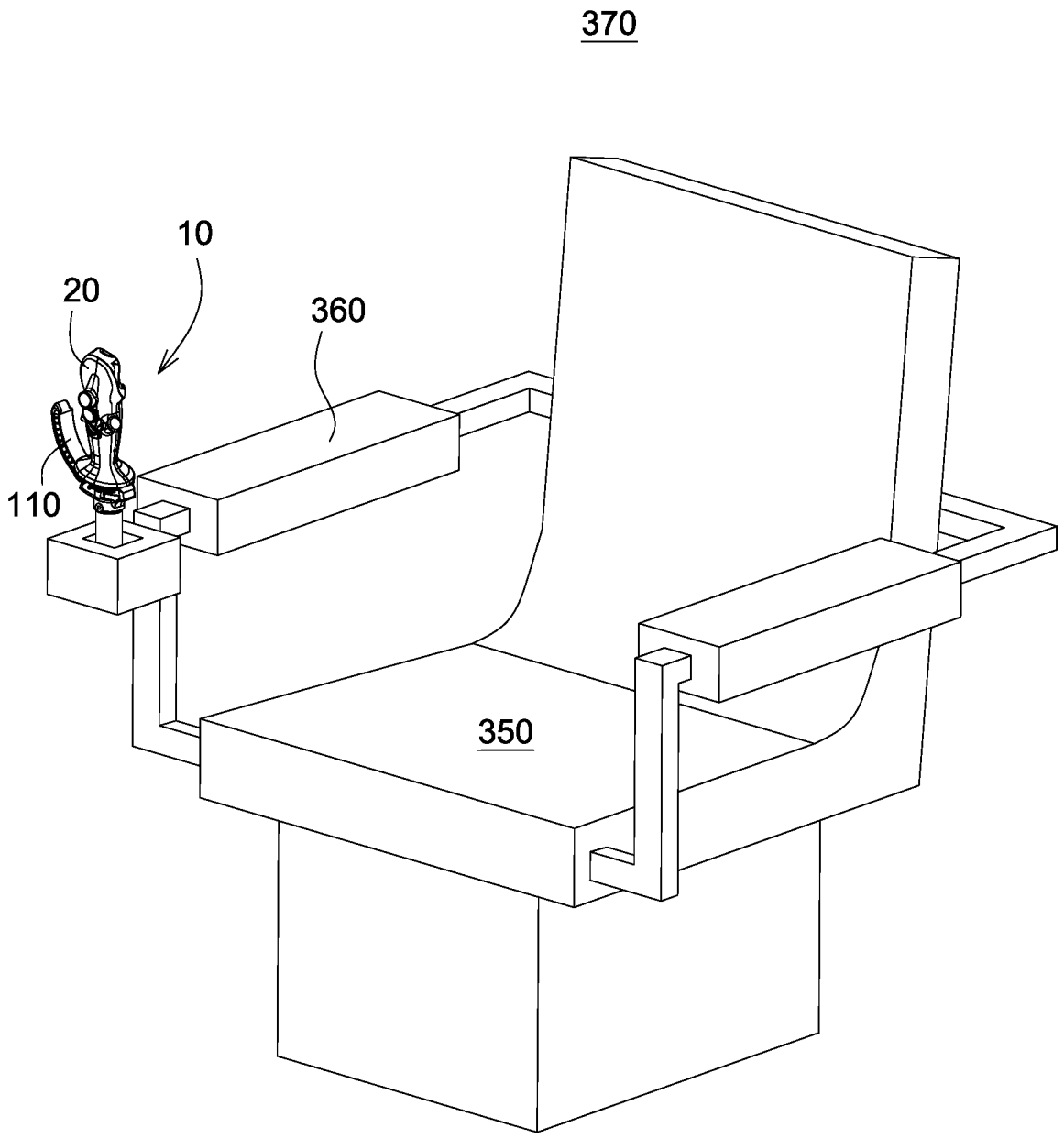
FIG. 12 is a perspective view of an operator's seat with an armrest to be used by an operator of a work machine, and fitted with the user input device assembly of the present disclosure.

FIG. 12 shows an exemplary operator seat for an operator station for use with a work machine 370 that typically has adjustable armrests, and/or an adjustable seat height. The user input device assembly 10 is generally independent from the operator seat 350, yet within reach when the operator's arm rests on the armrest 360. As the handle 20 of the user input device assembly 10 is adjusted from a pistol grip position 130 to a palm-on-top grip position 140, or alternatively from a palm-on-top grip position 140 to a pistol grip position 130, the centerline axis 260 (shown in FIGS. 6A-F) changes, thereby requiring the operator to adjust the armrest 360 position and/or seat height. The adjustable coupling mechanism 110 of the present disclosure eliminates this requirement by maintaining the same centerline axis 260 regardless of the handle 20 position.

Figure 7:
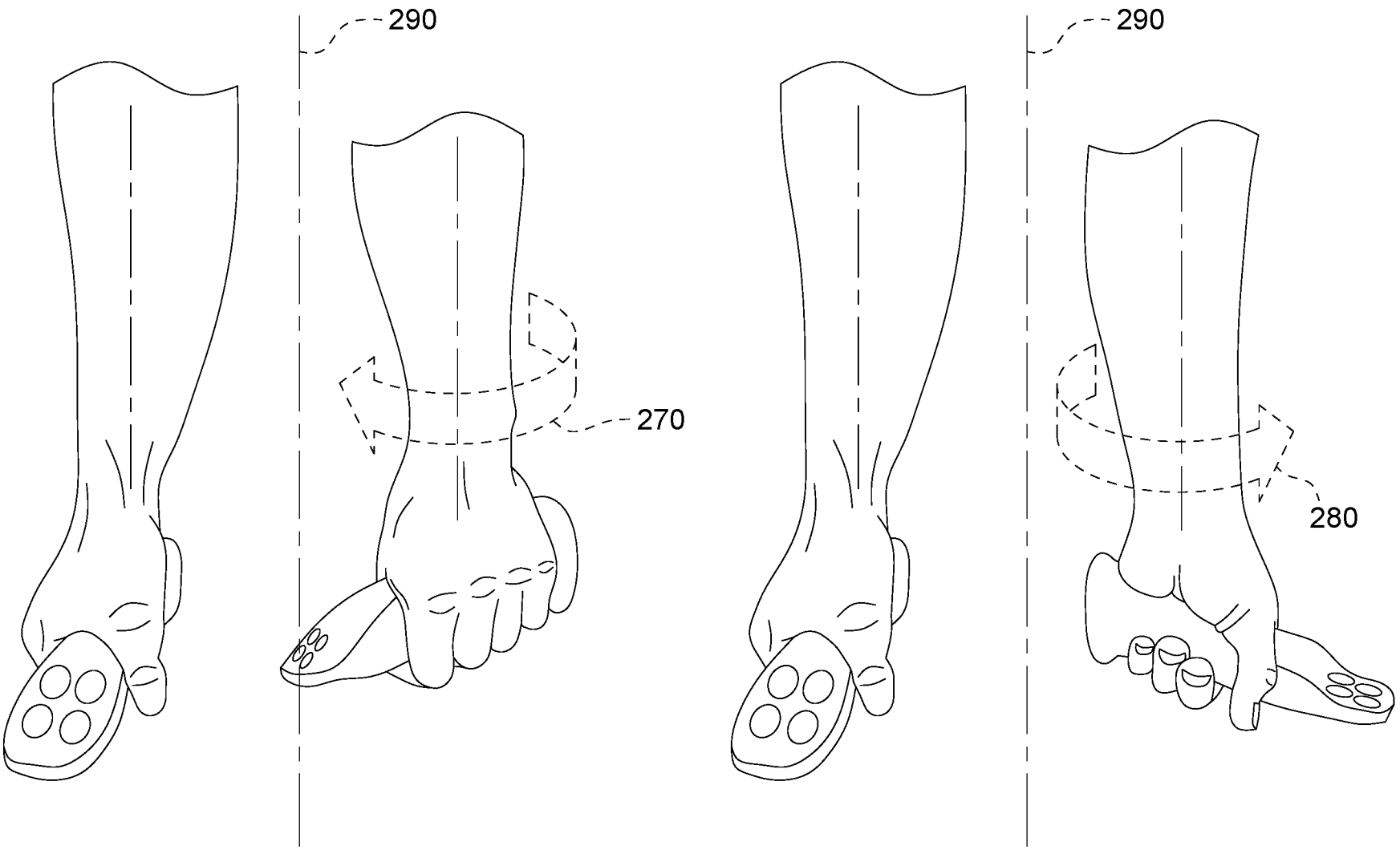
FIG. 7 is a diagram demonstrating medial and lateral rotation of an operator's palm.

FIG. 7 is a schematic diagram representing the medial rotation 270 and the lateral rotation 280 of an operator's palms 60. Medial rotation 270 is rotation of an operator's palms towards the midline 290. The midline 290 is the median plane of an operator's body in the vertical direction, wherein the midline is the halfway plane between an operator's first palm and an operator's second palm. Furthermore, medial rotation 270 rotates an operator's palm wherein the thumb is turned towards the midline 290. Contrary to medial rotation 270, lateral rotation 280 is rotation of an operator's palms away from the midline 290 wherein the thumb is turned away from the midline 290.

Figure 8:
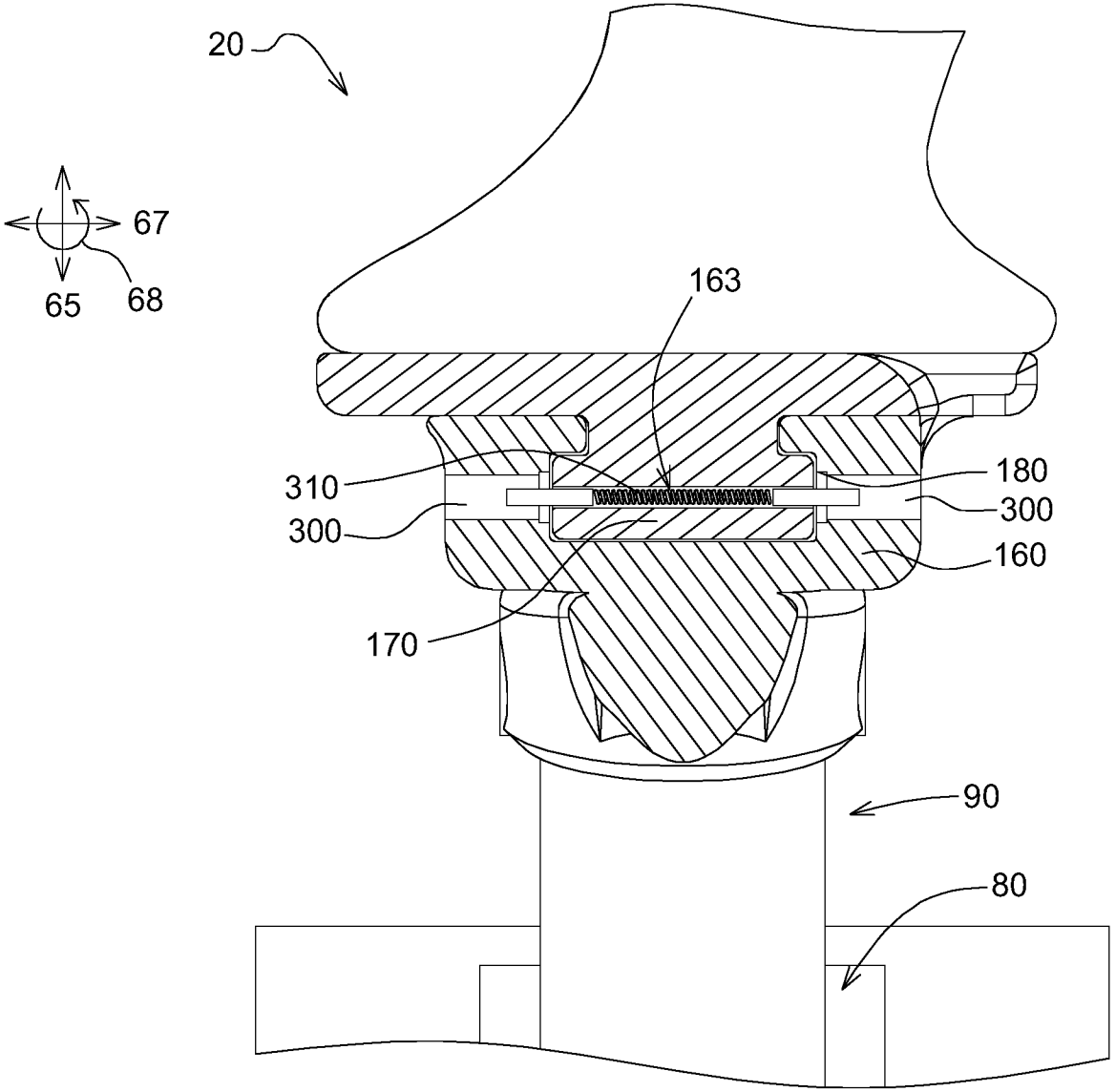
FIG. 8 is a cross-sectional back view of a second embodiment of the coupling mechanism.

In a second embodiment, a cross-sectional view along a similar axis 25 of FIG. 2, as FIG. 8 shows an adjustable coupling mechanism 110. The arched slide 160 of the adjustable coupling mechanism 110, is fixedly coupled to the first support portion 90 where the arched slide 160 has a groove 180 with the groove 180 having a row of detent apertures 300; and an adapter 170 fixedly coupled to the handle 20, where the adapter 170 is slidable within the groove 180 and selectively engages with the row of apertures 300 for locking the adapter 170 in a position. The adapter 170 may further comprise a detent 310 to receive a locking pin (not shown), where the locking pin 240 engages with the aperture on the arched slide and the detent 310 on the adapter to lock the adapter in a position. Alternatively, the adapter may further comprise a spring-loaded protrusion (not shown) where the protrusion engages with the aperture 300 to lock the adapter 170 in a position.

Figure 14:
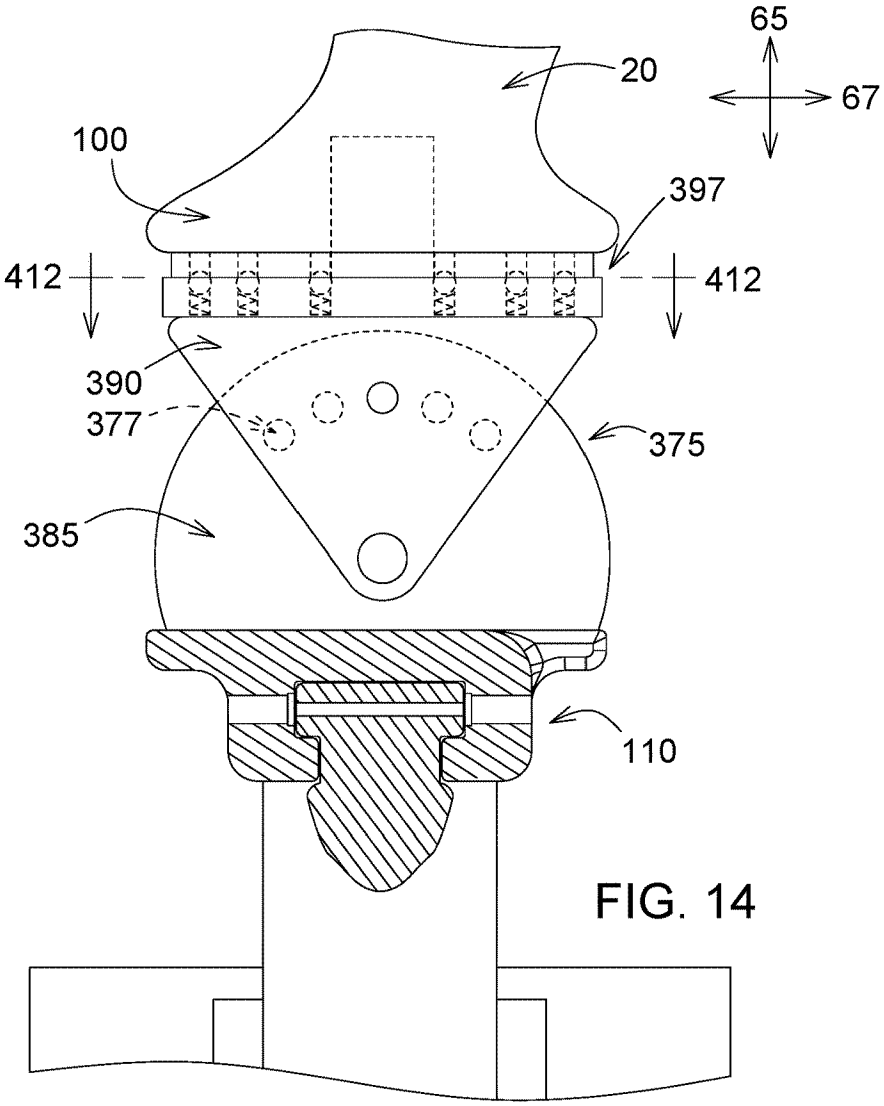
FIG. 14 is a back view of a third embodiment of the coupling mechanism.
Figure 13:
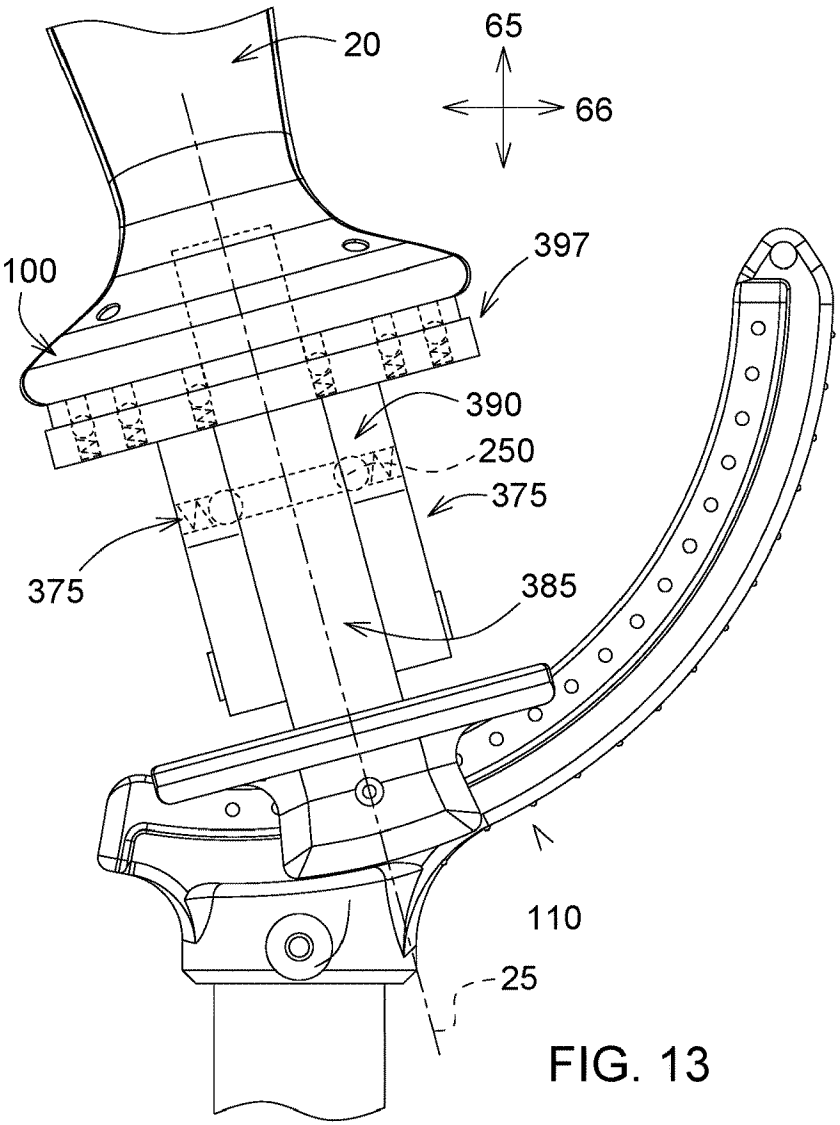
FIG. 13 is a side view of a third embodiment of the coupling mechanism.
Figure 15:
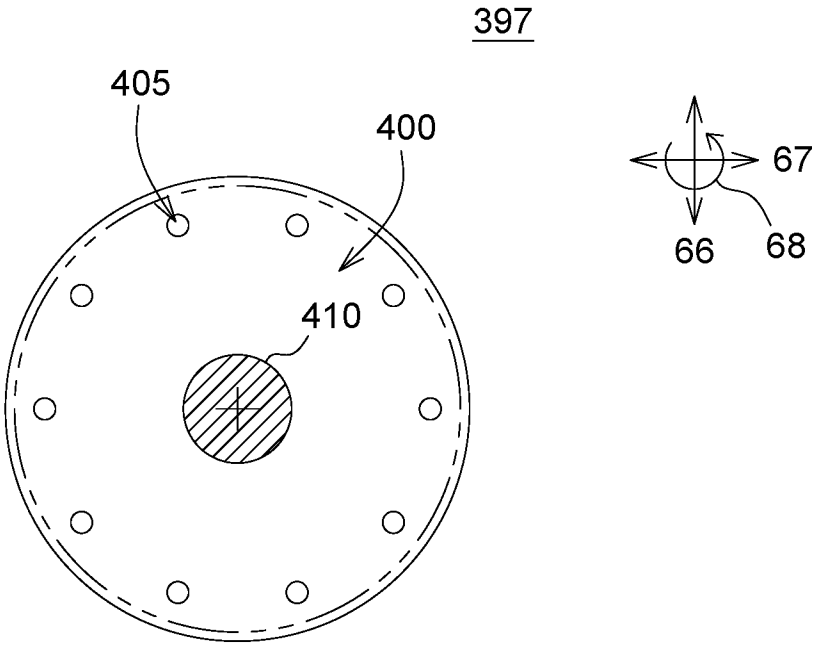
FIG. 15 is a cross-sectional top view of a portion of the third embodiment of the coupling mechanism.

FIGS. 13 and 14 are a side view and back view, respectively, of a third embodiment of the coupling mechanism. The embodiment in FIG. 13 comprises additional degrees of movement comprising a secondary coupling mechanism 375 and a third coupling mechanism 397, along with the adjustable coupling mechanism 110 (also shown in FIGS. 1 and 2) wherein the handle slidably adjusts to at least one of a pistol grip position 130, a palm-on-top grip position 140, and a plurality of positions therebetween 150. The adjustable coupling mechanism 110 moves the handle 20 in a plane comprising the horizontal dimension 66 and the vertical dimension 65. The secondary coupling 375 moves the handle in a plane perpendicular to the plane of the adjustable coupling mechanism (i.e. a plane in the lateral dimension 67). Using a similar mechanism to the adjustable coupling mechanism 110, the secondary coupling mechanism 375 further comprises a secondary row of detent notches 377, incrementally spaced along an arch 385 of the secondary coupler in lateral direction 67. This allows for the secondary adapter 390 to selectively engage with the secondary row of detent notches 377 (not all detent notches are identified) for locking the secondary adapter 390 in a position, as it pivots about a pivot axis 395. Engagement may occur with a locking pin (not shown), a spring-loaded protrusion engaging with a detent notch or another locking mechanism, as previously described for the adjustable coupling mechanism 110. Now turning to FIG. 15 with continued reference to FIGS. 13 and 14, a cross-sectional view of a third coupling mechanism 387 along axis 412 is shown. This top view shown in FIG. 15 shows a third coupler 400 comprising a row of detent notches 405 (not all detent notches are identified) interspersed in a circular fashion about the axis 410 of the second support portion 100, allowing the handle 20 to selectively engage for locking the handle 20 in a position while rotating about the axis 410 of the second support portion 100. The first support portion 90 of the handle 20 may be angled relative to the second support portion axis 410. Similar to the adjustable locking mechanism 110, and the secondary coupling mechanism 375, the third coupling mechanism 397 may also use a locking pin (not shown), a spring-loaded protrusion (not shown), or other similar mechanism to engage a detent notch. It should be understood, that various embodiments of that coupling mechanism for the handle 20 to the elongated support 80 may comprise either one, or more of the above-mentioned coupling mechanisms (110, 375, 397).

Figure 11:
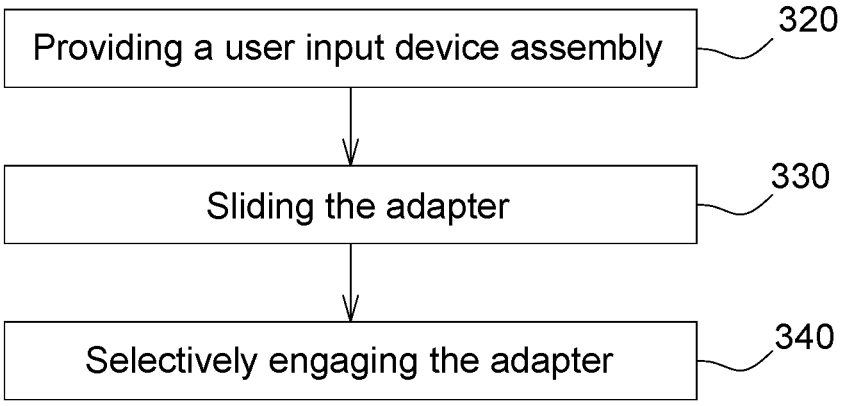
FIG. 11 is a flow diagram showing one example of expanding the functionality of a user input device assembly for a work machine.

FIG. 11 is a flow diagram showing one example of expanding the functionality of a user input device assembly for a work machine where the user input device assembly includes a pistol grip position, a palm-on-top grip position, and a plurality of positions therebetween. The method comprises providing a user input device assembly 320, sliding the adapter 330, and selectively engaging the adapter 340. The user input device assembly 10 comprises a handle 20 having a palm portion 50 for receiving the palm of an operator's hand 60; an elongated support 80 having a first support portion 90 and a second support portion 100, the first support portion 90 coupled to the handle 20 through an adjustable coupling mechanism 110 and the second support portion 100 coupled to the control console 120. The adjustable coupling mechanism 110 may have an arched slide 160 having a row of detent notches 190, where the arched slide 160 is fixedly coupled to the elongated support 80. The adjustable coupling mechanism 110 may further comprise an adapter 170 with a groove 180, where the adapter 170 is fixedly coupled to the handle 20, and the arched slide 160 is retained in the groove of the adapter 170. The row of detent notches 190 may be incrementally spaced. The first detent notch 200 may couple the handle 20 to a pistol grip position 130 and a second detent notch 210 may couple the handle 20 to a palm-on-top grip position 220. The remaining detent notches may couple the handle 20 to a position therebetween. The palm portion 50 of the handle 20 for receiving the palm of the operator's hand maintains a consistent axis of rotation 260 coinciding with at least one of a medial rotation 270 and a lateral rotation 280 of the operator's palm when adjusting from at least one of the pistol grip position 130, the palm-on-top grip position 140, and the plurality of positions therebetween 150.

While the above describes example embodiments of the present disclosure, these descriptions should not be viewed in a limiting sense. Rather, other variations and modifications may be made without departing from the scope and spirit of the present disclosure as defined in the appended claims.

What is claimed is:

1. A work machine including a control console and an adjustable user input device assembly, the user input device assembly comprising:

a handle having a first portion, a second portion, and a palm portion for receiving the palm of an operator's hand, the palm portion located between the first portion and the second portion; and an elongated support having a first support portion and a second support portion, the first support portion coupled to the handle through an adjustable coupling mechanism, the second support portion coupled to the control console;

the adjustable coupling mechanism configured to slidably adjust the handle to at least one of a pistol grip position, a palm-on-top grip position, and a plurality of positions therebetween, wherein the adjustable coupling mechanism comprises:

an arched slide, the arched slide fixedly coupled to the first support portion, the arched slide having a row of detent notches;

an adapter with a groove, the adapter fixedly coupled to the second portion of the handle;

the arched slide retained in the groove of the adapter; and the adapter being slidable along the arched slide and being selectively engageable with the row of detent notches for locking the adapter in a position.

2. The user input device assembly of claim 1, wherein the row of detent notches are incrementally space.

3. The user input device assembly of claim 1, wherein a first detent notch couples the handle to a pistol grip position and a second detent notch couples the handle to a palm-on-top grip position.

4. The user input device assembly of claim 1, wherein the adapter further comprises:

an aperture to receive a locking pin, the locking in engaging with the detent to lock the adapter in a position, the position being at least one of the pistol grip position, the palm-on-top grip position, and the plurality of positions therebetween.

5. The user input device assembly of claim 1, wherein the adapter further comprises:

a spring-loaded protrusion located in the groove, the protrusion engaging with the detent to lock the adapter in a position, the position being at least one of the pistol grip position, the palm-on-top grip position, and the plurality of positions therebetween.

6. The user input device assembly of claim 1, wherein the handle further comprises:

a thumb rest coupled to the first portion of the handle.

7. The user input device assembly of claim 1, wherein the palm portion maintains a consistent axis of rotation when adjusting from the pistol grip position, the palm-on-top position, and the plurality of positions therebetween.

8. A work machine including a control console and an adjustable user input device assembly, the user input device assembly comprising:

a handle having a palm portion for receiving the palm of an operator's hand; and an elongated support having a first support portion and a second support portion, the elongated support coupled on the first support portion to the handle through an adjustable coupling mechanism, and coupled on the second support portion to the control console, the adjustable coupling mechanism configured to slidably adjust the handle to at least one of a pistol grip position, a palm-on-top grip position, and a plurality of positions therebetween;

the adjustable coupling mechanism comprising:

an arched slide, the arched slide fixedly coupled to the first support portion, the arched slide having a groove, the groove having a row of detent apertures; and an adapter fixedly coupled to the handle, the adapter being slidable within the groove and being selectively engageable with the row of detent apertures for locking the adapter in a position.

9. The user input device assembly of claim 8, wherein the row of detent apertures are incrementally spaced.

10. The user input device assembly of claim 8, wherein a first detent aperture couples the hand to a pistol grip position and a second aperture couples the handle to a palm-on-top grip position.

11. The user input device assembly of claim 8, wherein the adapter further comprises:

a detent to receive a locking pin, the locking pin engaging with the aperture on the arched slide to lock the adapter in a position, the position being at least one of the pistol grip position, the palm-on-top grip position, and the plurality of positions therebetween.

12. The user input device assembly of claim 8, wherein the adapter further comprises:

spring-loaded protrusion, the protrusion engaging with the aperture to lock the adapter in a position, the position being at least one of the pistol grip position, the palm-on-top grip position, and the plurality of positions therebetween.

13. The user input device assembly of claim 8, wherein the palm portion maintains a consistent axis of rotation when adjusting from the pistol grip position, the palm-on-top grip position, and the plurality of positions therebetween.

14. A method of expanding the functionality of a user input device assembly for a control console, the user input device assembly including a pistol grip position, a palm-on-top grip position, and a plurality of positions therebetween, the method comprising:

providing a user input device assembly including a handle having a palm portion for receiving the palm of an operator's hand; an elongated support having a first support portion and a second support portion, the first support portion coupled to the handle through an adjustable coupling mechanism and the second support portion coupled to the control console;

the adjustable coupling mechanism having an arched slide having a row of detent notches, the arched slide fixedly coupled to the elongated support; an adapter with a groove, the adapter fixedly coupled to the handle; the arched slide retained in the groove of the adapter;

sliding the adapter along the arched slide;

selectively engaging the adapter with a detent notch of the row of detent notches to lock the adapter in a desired position.

15. The method of claim 14, wherein the row of detent notches are incrementally spaced.

16. The method of claim 14, wherein a first detent notch couples the handle to a pistol grip position and a second detent notch couples the handle to a palm-on-top position.

17. The method of claim 14, wherein the adapter further comprises:

a spring-loaded protrusion, the protrusion engaging with the detent to lock the adapter in a position, the position being at least one of the pistol grip position, the palm-on-top grip position, and the plurality of positions therebetween.

18. The method of claim 14, wherein a first detent notch couples the handle to the pistol grip position and a second detent notch couples the handle to the palm-on-top grip position.

19. The method of claim 14, wherein the palm portion maintains a consistent axis of rotation when adjusting from at least one of the pistol grip position, the palm-on-top grip position, and the plurality of positions therebetween.

* * * * *